US006036625A

United States Patent [19]

Woodruff

[11] Patent Number: 6,036,625

[45] Date of Patent: Mar. 14, 2000

[54] UPPER BODY EXERCISE EQUIPMENT

[76] Inventor: Allen C. Woodruff, 1624 Forsyth Rd., Orlando, Fla. 32807

[21] Appl. No.: 09/063,084

[22] Filed: Apr. 21, 1998

Related U.S. Application Data

[60] Provisional application No. 60/044,304, Apr. 30, 1997.

[51] Int. Cl.[7] ..... A61S 5/00

[52] U.S. Cl. ..... 482/121; 482/124; 482/129

[58] Field of Search ..... 482/10, 83, 904, 482/79, 121, 124, 129

[56] References Cited

U.S. PATENT DOCUMENTS

| | | | |
|---|---|---|---|
| 1,517,147 | 11/1924 | Burnett | 482/10 |
| 1,543,346 | 6/1925 | Titus | 482/10 |
| 4,832,333 | 5/1989 | Lockett . | |
| 4,988,093 | 1/1991 | Forrest, Sr. et al. . | |
| 5,209,482 | 5/1993 | Hopfer | 482/904 |
| 5,389,057 | 2/1995 | Zagata | 482/83 |
| 5,458,552 | 10/1995 | Mara | 482/90 |
| 5,505,677 | 4/1996 | Hinds | 482/10 |

OTHER PUBLICATIONS

Neck Trainer Product Information (No Date) Rockett Exercise Concepts Inc.

*Primary Examiner*—Jerome Donnelly
*Attorney, Agent, or Firm*—James E. Bradley

[57] ABSTRACT

A neck exercise apparatus has a cord and a head strap. The cord is formed from a highly elastic, rubberized tube and has a mounting strap secured to one end. A spring clip is secured to the opposite end of the mounting strap. A foam rubber pad surrounds each end of the tube. The head strap has a flexible, inelastic body with two hook and loop fastening straps on each end. The body also has several rings on an outer side and an elastic head support on an inner side. A variety of exercises may be performed with the apparatus. Prior to use, the mounting strap is inserted between a door and its inner door jamb so that the mounting strap is held in place. The user attaches the spring clip to one of the rings and the head strap is placed on the head. The head strap may be adjusted for fit by adjusting the position of the hook and loop flaps. With tension in the cord, the user then exercises the extension muscles of the neck by slowly tilting the head at the neck away from the door.

3 Claims, 5 Drawing Sheets

UPPER BODY EXERCISE EQUIPMENT

This applications claim benefit to U.S. Provisional application Ser. No. 60/044,304 filed Apr. 30, 1997.

TECHNICAL FIELD

This invention relates in general to exercise equipment and in particular to a portable upper body exercise device.

BACKGROUND OF THE INVENTION

Personal exercise or physical therapy equipment can be large, bulky and very expensive. This type of equipment, usually for strengthening exercises, may require a significant amount of floor or storage space and is not always portable. Other types of equipment, such as gentle strengthening or stretching equipment, are designed to be compact, portable and inexpensive. However, this type of equipment typically utilizes uncomfortable hard plastic handles and cords which may pinch the body or cause bruises by diminishing blood circulation. An inexpensive, portable exercise device which is also comfortable to use is needed.

SUMMARY OF THE INVENTION

A neck exercise apparatus has a cord and a head strap. The cord is formed from a highly elastic, rubberized tube and has a mounting strap secured to one end. A spring clip is secured to the opposite end of the mounting strap. A foam rubber pad surrounds each end of the tube. The head strap has a flexible, inelastic body with two hook and loop fastening straps on each end. The body also has several rings on an outer side and an elastic head support on an inner side.

A variety of exercises may be performed with the apparatus. Prior to use, the mounting strap is inserted between a door and its inner door jamb so that the mounting strap is held in place. The user attaches the spring clip to one of the rings and the head strap is placed on the head. The head strap may be adjusted for fit by adjusting the position of the hook and loop flaps. With tension in the cord, the user then exercises the extension muscles of the neck by slowly tilting the head at the neck away from the door.

A second embodiment of the apparatus has a thin elastic rubber tube which is formed into a large loop on each end. A nonelastic attachment strap is secured to a central portion of the rubber tube. A thick tubular foam rubber pad is wrapped around the attachment strap and tube interface and at each of the two loop intersections. Each foam rubber pad has an axial hole through which the rubber tube passes.

Prior to use, the apparatus may be anchored by inserting the attachment strap between the hinged side of an open door and its inner door jamb. The door is closed so that the attachment strap is held in place. In one of a variety of exercises that may be performed by the apparatus, the user inserts an arm through each loop and comfortably positions the pads along the shoulders, back and underarms. While seated and maintaining an upright back position, the user flexes at the waist away from and toward the door. This movement isolates and exercises the upper back and shoulders.

BEST MODE FOR CARRYING OUT THE INVENTION

Figure 1:
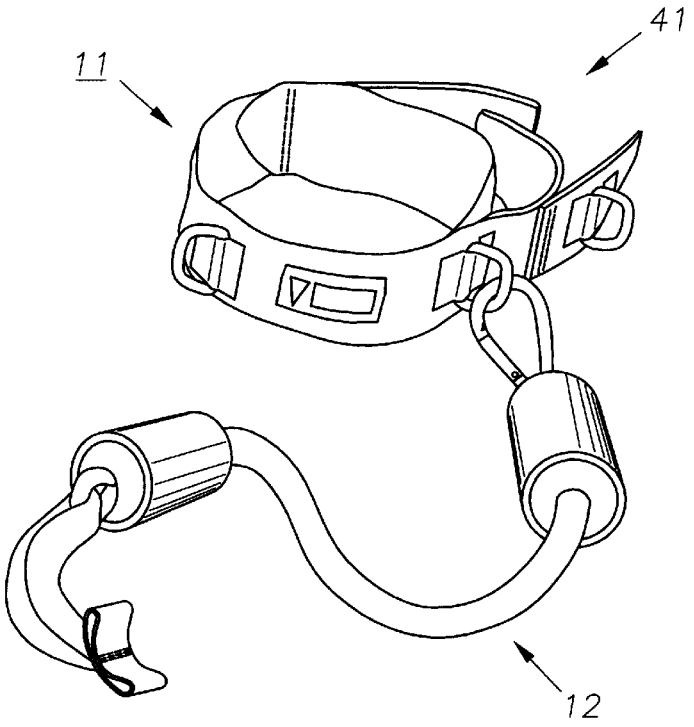
FIG. 1 is an isometric view of a cervical exercise apparatus constructed in accordance with the invention.
Figure 2:
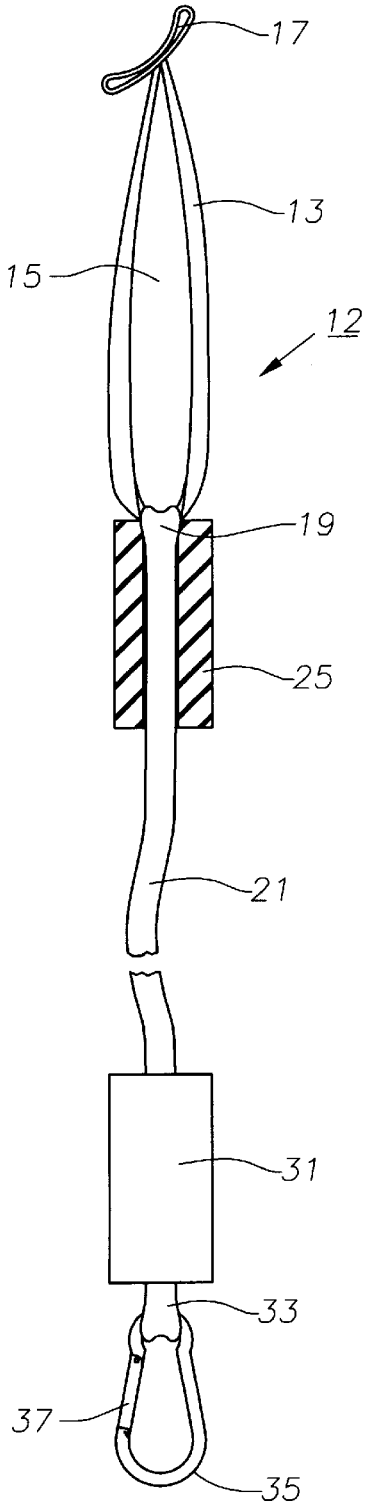
FIG. 2 is a partial sectional side view of a cord portion of the apparatus of FIG. 1.

Referring to FIG. 1, a portable cervical or neck exercise apparatus 11 having a cord 12 and a head strap 41 is shown. As shown in FIG. 2, cord 12 has a flat attachment strap 13 that is folded in half to form a small loop 15. In the preferred embodiment, strap 13 is approximately one inch wide and is fabricated from nonelastic, braided nylon. The two end pieces of strap 13 are placed together, folded over on one another and sewn so that a "T" is formed on a distal end 17 of strap 13.

The proximate end of strap 13 is secured to a looped end 19 of a highly elastic, rubberized tube 21. Tube 21 is approximately three-eighths of an inch in diameter. Loop 19 is formed by clamping tube 21 to itself. A foam rubber pad 25 is located around the clamp of loop 19 on tube 21. Thus, loop 15 extends from T-end 17 to pad 25 and is approximately six inches long when in the flattened position. Pad 25 is a short, cylindrical tube with a small axial hole and has a outside diameter of approximately 1.5 inches. Tube 21 is inserted through the hole in pad 25 which has a diameter that is approximately equal to the outside diameter of tube 21 so that a tight frictional fit is achieved.

A second pad 31 is located on a proximal end of cord 12 adjacent to a looped end 33 of tube 21. Pad 31 and loop 33 are identical to pad 25 and loop 19, respectively. A metallic hook or clip 35 is secured to loop 19. Clip 35 has a spring-loaded tab 37 that is biased to a closed position. Tab 37 may be pivoted to an open position by pushing it toward clip 35.

Figure 3:
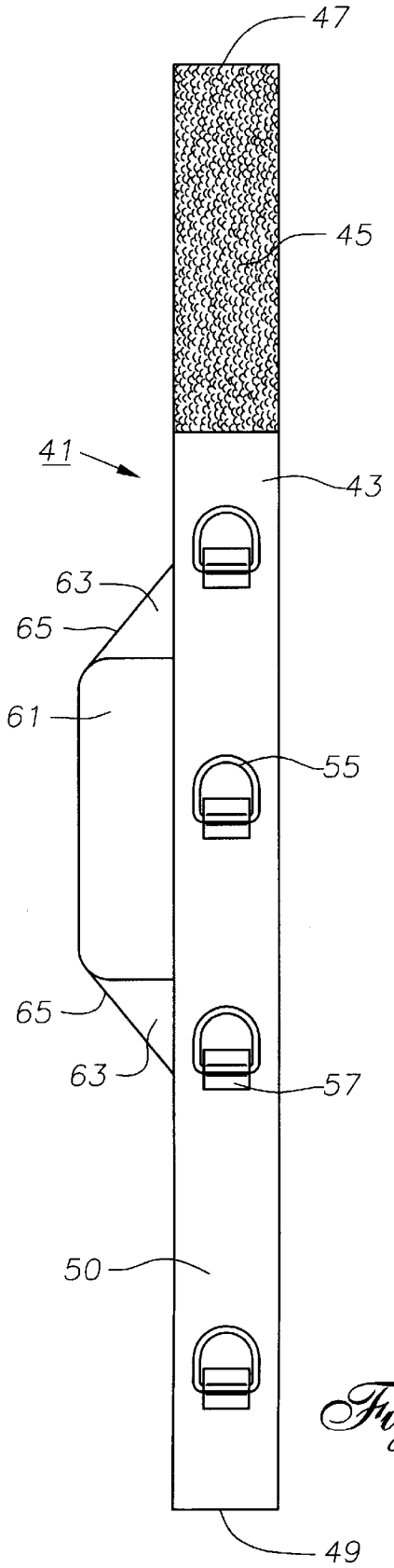
FIG. 3 is an upper plan view of a head strap of the apparatus of FIG. 1.
Figure 4:
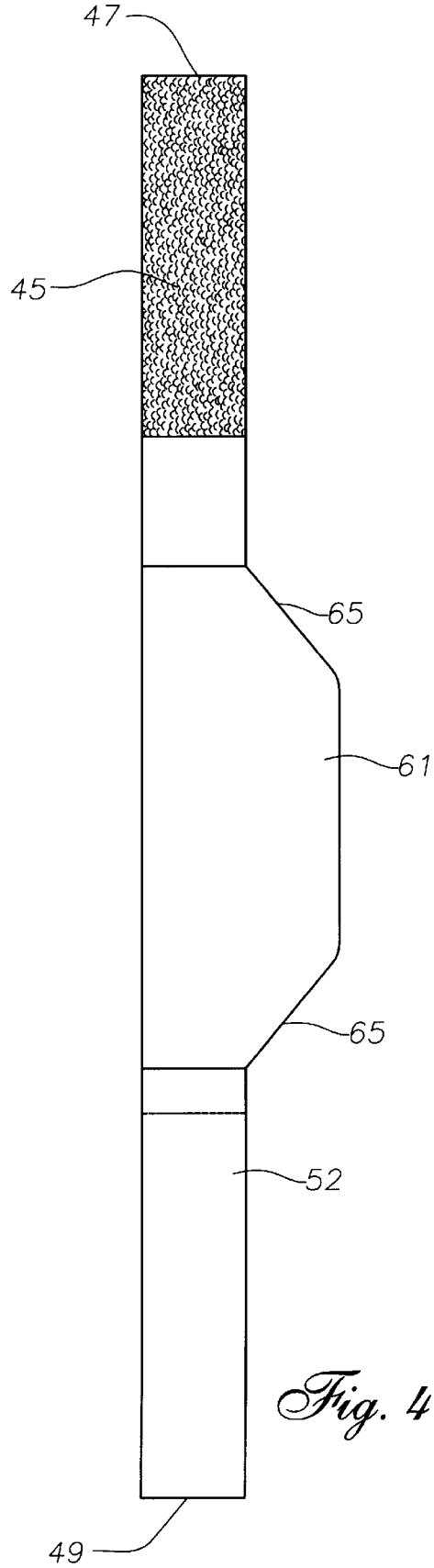
FIG. 4 is a lower plan view of the head strap of FIG. 3.
Figure 5:
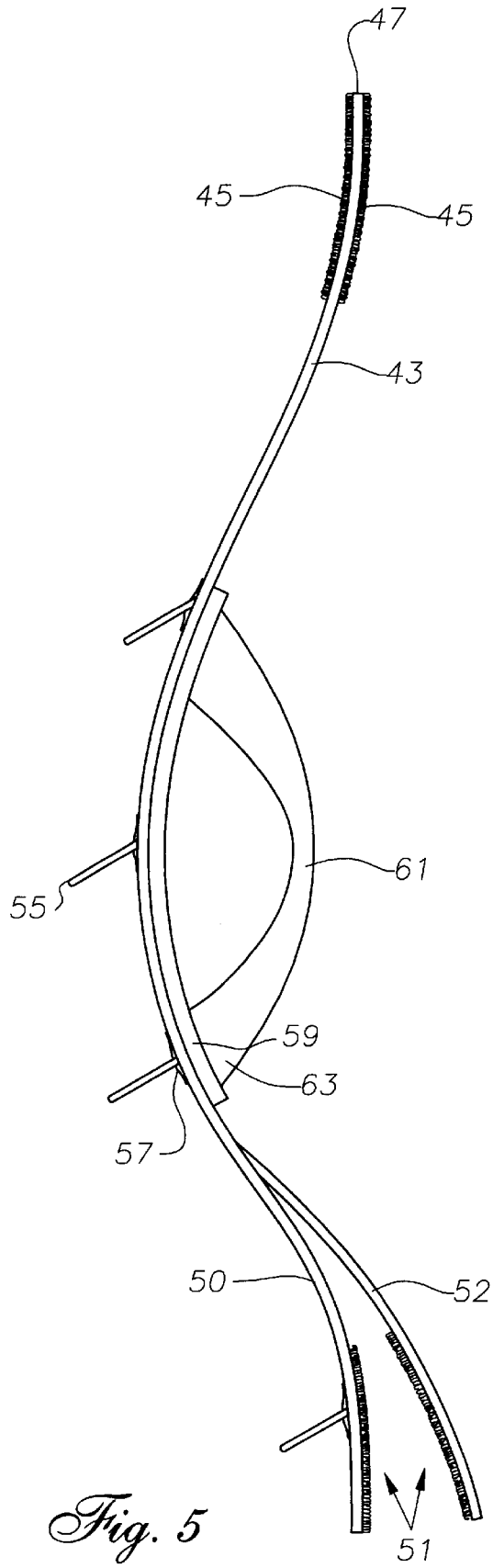
FIG. 5 is a side view of the head strap of FIG. 3.

Referring to FIGS. 3–5, a head strap 41 has a flexible, inelastic, rectangular strap body 43 that is covered with hook and loop fastening material 45 on both sides of one end 47. Strap body 43 is approximately 27.5 inches long, two inches wide and preferably comprises woven nylon fabric. End 49 is opposite of end 47 and comprises two flaps 50, 52 (FIG. 5), each of which has hook and loop fastening material 51 sewn to an inner side. Flap 52 is seven inches long and is sewn to strap body 43. Strap body 43 also has four, D-shaped rings 55 sewn to an outer side with a small piece of material 57 (FIGS. 3, 5). Rings 55 are rigid and preferably formed from nylon. Rings 55 are spaced 2.0, 8.5, 13.25, and 18.0 inches from end 49, respectively, and are centered across the width of strap body 43. A foam rubber pad 59 is sewn to an inner side of strap body 43. Pad 59 is about 11.5 inches long and two inches wide.

An elastic head support 61 has spaced apart ends 63 sewn to the inner side of strap body 43. Head support 61 is 11.5 inches long and is four inches wide. Head support 61 is wider than strap body 43 and extends below it. As shown in FIGS. 3 and 4, the lower outer ends 63 of head support 61 are folded upward and inward along 45 degree diagonal fold lines 65. Ends 63 are sewn to the edges of pad 59 and strap body 43.

Figure 6:
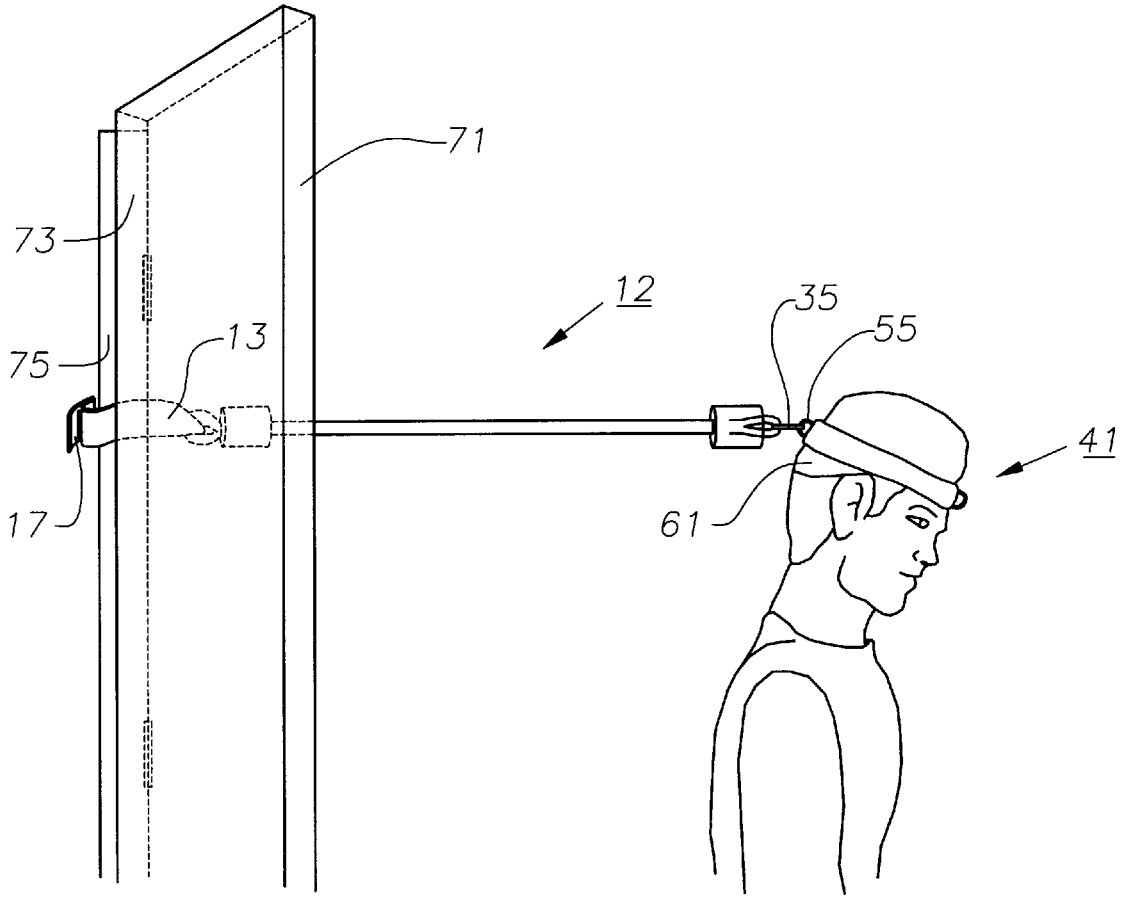
FIG. 6 is a schematic drawing of the apparatus of FIG. 1 in operation.

In operation, a variety of exercises, including sliding and rotating motions of the head and neck, may be performed with apparatus 11. Most exercises are performed while the user is in a sitting position. The exercise illustrated in FIG. 6 may be performed while seated or standing. In order to anchor apparatus 11, T-end 17 is inserted between the hinged side 73 of an open door 71 and its inner door jamb 75. For this particular exercise, strap 13 is located above the user's eye level while standing. The proper mounting height of strap 13 will allow cord 12 to remain substantially horizontal during use. Door 71 is then closed and locked from the user's side. When door 71 is closed, strap 13 will be squeezed and held in place between door 71 and door jamb 75. Strap 13 will be retained in this position until door 71 is reopened and T-end 17 is removed. When properly installed, the cross bar portion of T-end 17 will be on one side of door 71 and the remainder of strap 13 and apparatus 11 will be on the other. Alternatively, apparatus 11 may also be anchored by placing loop 15 over a bar or pole (not shown).

The user attaches clip 35 to one of rings 55, depending upon the direction of desired resistance and the side of the user's neck to be exercised. Tab 37 should return to the closed position after clip 35 is attached. Head strap 41 is placed around the sides of the head so that head support 61 supports the occipital region or back of the head. Head strap 41 is formed into a circular shape around the head and end 47 is placed between flaps 50, 52. The circumference of head strap 41 may be adjusted for fit by pulling flap 50 away from end 47 and then pulling end 47 away from flap 52. End 47 is then relocated inward or outward to reduce or enlarge, respectively, the circumference of head strap 41.

When head strap 41 is properly installed, head strap 41 should be comfortable and secure from movement. The four rings 55 should be located on the front, back and each side of the head, respectively. The user then moves slowly away from door 71 until a slight amount of tension is perceived from cord 12. While remaining in an upright position and without further movement of the body, the user then exercises the extension muscles of the cervical region of the spine by slowly tilting the head at the neck away from door 71. This movement is repeated for a desired number of repetitions. Head support 61 prevents head strap 41 from slipping off or sliding around the head during rotation, retraction and extension exercises. Head support 61 performs this critical function by generating a counterforce to the direction of the force generated by strap 12. For example, if the user is performing a rotation exercise in the clockwise direction (not shown), head strap 61 generates a resultant counter-clockwise force. Apparatus 11 may be used for complete neck rehabilitation. To exercise other areas of the neck musculature, cord 12 is simply connected to a different ring 55.

Figure 7:
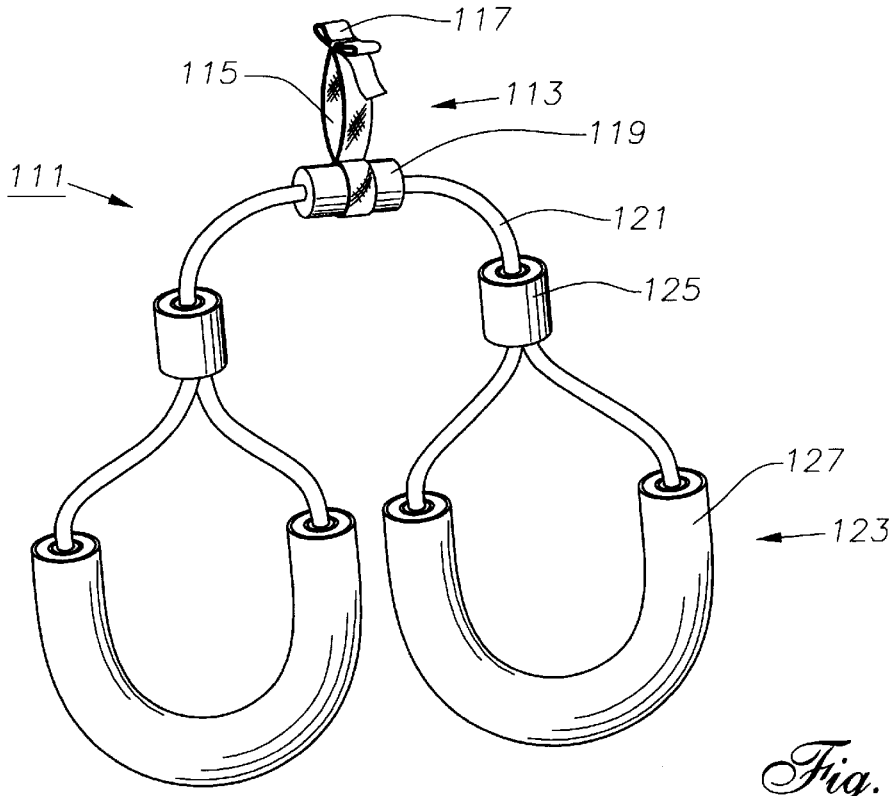
FIG. 7 is an isometric view of a second embodiment of the apparatus of FIG. 1.

Referring to FIG. 7, a second embodiment of the invention is shown. A personal exercise apparatus 111 has a flat attachment strap 113 that is folded in half to form a small loop 115. In the preferred embodiment, strap 113 is approximately one inch wide and is fabricated from nonelastic, braided nylon. The two end pieces of strap 113 are placed together, folded over on one another and sewn so that a "T" or perpendicular portion is formed on a distal end 117 of strap 113.

The proximate end of strap 113 is wrapped tightly around a central portion of a foam rubber pad 119 and sewn to itself. Loop 115 extends from T-end 117 to pad 119 and is approximately six inches long when flattened. Pad 119 is a short, cylindrical tube with a small axial hole and has a diameter of approximately one inch. A highly elastic, rubberized tube 121 is inserted through the hole in pad 119. Tube 121 is approximately three-eighths of an inch in diameter when it is in a relaxed state. Each end of tube 119 is formed into a large loop 123 and clamped to itself. Loops 123 are approximately eighteen inches in diameter. A pad 125 is located around each clamp on tube 119. Pads 125 are larger in diameter than pad 119, but are otherwise identical. A collar pad 127 is located on the distal end of each loop 123. Pads 127 are longer than pads 125, but are otherwise identical. Each pad 127 has an axial hole with a diameter that is approximately equal to the outside diameter of tube 119 so that a tight frictional fit is achieved.

Figure 8:
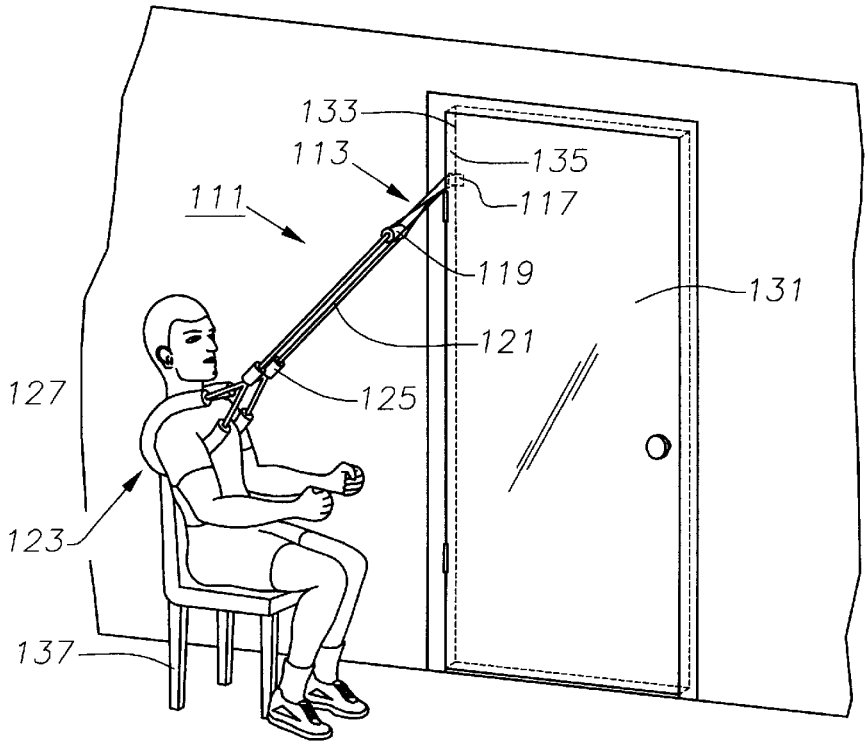
FIG. 8 is a schematic drawing of the apparatus of FIG. 7 in operation.

In operation, a variety of exercises may be performed by using apparatus 111. FIG. 8 illustrates one such exercise. Prior to use, apparatus 111 may be anchored by inserting T-end 117 between the hinged side 133 of an open door 131 and its inner door jamb 135. For this particular exercise, strap 113 should be located above the user's eye level while standing. Door 131 is then closed and locked from the user's side. When door 131 is closed, strap 113 will be squeezed and held in place between door 131 and door jamb 135. Strap 113 will be retained in this position until door 131 is reopened and T-end 117 is removed. When properly installed, the cross bar portion of T-end 117 will be on one side of door 131 and the remainder of strap 113 and apparatus 111 will be on the other. Alternatively, apparatus 111 may also be anchored by placing loop 115 over a bar or pole.

The user positions a chair 137 near apparatus 111 and inserts one arm through each loop 123. Pads 127 should be comfortably positioned along the shoulders, back and underarms before the user is seated. Chair 137 may be repositioned from door 131 for desired resistance. While maintaining an upright back position, the user repetitively flexes at the waist away from and toward door 131. This movement isolates and exercises the upper back and shoulders.

The invention has several advantages. The improved apparatus is completely portable, lightweight and requires very little space during use and when placed in storage. The apparatus is also designed to be significantly more comfortable than related prior art exercise devices and is relatively inexpensive. The soft rubber tubing and foam rubber padding does not pinch or reduce circulation. The intensity of the workout during use of the apparatus is easily manipulated by varying the user's distance from the mounting strap.

While the invention has been shown or described in only some of its forms, it should be apparent to those skilled in the art that it is not so limited, but is susceptible to various changes without departing from the scope of the invention.

I claim:

1. An exercise apparatus, comprising in combination:

a door mounted on a hinged edge to a door jamb and having first and second sides;

an elastic cord formed from a material which is suitable for a range of strengthening and stretching exercises;

a mounting member secured to one end of the cord, releasably extending between the door and the door jamb when the door is closed and having a portion locating on the first side of the door;

a head strap secured to an opposite end of the cord and adapted to be adjustably fitted to a head of a user for performing strengthening and stretching exercises with the head and neck; and wherein the head strap comprises an inelastic strap having two ends with mating hook and loop fasteners on the ends of the strap for securing about a user's head;

at least one eyelet on an outer surface of the strap for connecting the cord to the head strap; and an elastic head support attached to an inner surface of the strap and extending partially below the strap for fitting about a back of the head of the user.

2. An exercise apparatus, comprising:

an elastic tube formed from a material which is suitable for a range of strengthening and stretching exercises;

an inelastic mounting strap secured to one end of the tube, the mounting strap having a flexible, generally T-shaped mounting portion which is adapted to extend between a closed door and its adjacent door jamb to retain said one end of the tube;

a head strap secured to an opposite end of the tube and adapted to be adjustably fitted to a head of a user for performing strengthening and stretching exercises with the head and neck; and wherein the head strap has an inelastic strap body with a padded inner surface and an elastic head support.

3. An exercise apparatus, comprising:

an elastic tube formed from a material which is suitable for a range of strengthening and stretching exercises;

an inelastic mounting strap secured to one end of the tube, the mounting strap having a flexible, generally T-shaped mounting portion which is adapted to extend between a closed door and its adjacent door jamb to retain said one end of the tube;

a head strap secured to an opposite end of the tube and adapted to be adjustably fitted to a head of a user for performing strengthening and stretching exercises with the head and neck; and wherein the head strap comprises an inelastic strap having two ends with mating hook and loop fasteners on the ends of the strap for securing about a user's head;

at least one eyelet on an outer surface of the strap for connecting the cord to the head strap; and an elastic head support attached to an inner surface of the strap and extending partially below the strap for fitting about a back of the head of the user.

* * * * *